US009835316B2

(12) United States Patent
Baek et al.

(10) Patent No.: US 9,835,316 B2
(45) Date of Patent: Dec. 5, 2017

(54) FRAME AND LIGHT SOURCE MODULE INCLUDING THE SAME

(71) Applicant: Samsung Display Co., Ltd., Yongin, Gyeonggi-Do (KR)

(72) Inventors: Seung Hwan Baek, Seoul (KR); Myeong Ju Shin, Seoul (KR); Yeong Bae Lee, Suwon-si (KR)

(73) Assignee: Samsung Display Co., Ltd. (KR)

( * ) Notice: Subject to any disclaimer, the term of this patent is extended or adjusted under 35 U.S.C. 154(b) by 176 days.

(21) Appl. No.: 14/293,817

(22) Filed: Jun. 2, 2014

(65) Prior Publication Data

US 2015/0219323 A1 Aug. 6, 2015

(30) Foreign Application Priority Data

Feb. 6, 2014 (KR) ..... 10-2014-0013721

(51) Int. Cl.

| | |
|---|---|
| ***F21V 21/00*** | (2006.01) |
| ***F21K 99/00*** | (2016.01) |
| ***F21V 9/08*** | (2006.01) |
| ***F21V 19/00*** | (2006.01) |
| ***F21V 19/04*** | (2006.01) |
| ***F21K 9/64*** | (2016.01) |
| *F21Y 115/10* | (2016.01) |

(52) U.S. Cl.

CPC ..... *F21V 21/00* (2013.01); *F21K 9/64* (2016.08); *F21V 9/08* (2013.01); *F21V 19/0045* (2013.01); *F21V 19/045* (2013.01); *F21Y 2115/10* (2016.08)

(58) Field of Classification Search

CPC .... F21V 21/00; F21V 19/045; F21V 19/0045; F21V 9/08; F21V 19/003; F21V 19/0035; F21V 19/004; F21K 9/56; F21K 9/64

See application file for complete search history.

(56) References Cited

U.S. PATENT DOCUMENTS

| | | | | |
|---|---|---|---|---|
| 3,719,941 | A * | 3/1973 | Dickey | B60Q 3/14 340/815.49 |
| 6,517,213 | B1 * | 2/2003 | Fujita | G09F 13/04 362/23.18 |
| 8,227,828 | B2 | 7/2012 | Li et al. | |
| 9,632,029 | B2 * | 4/2017 | Ikami | G01N 21/6456 |

(Continued)

FOREIGN PATENT DOCUMENTS

| | | |
|---|---|---|
| JP | 2011-119248 | 6/2011 |
| JP | 2011-187896 | 9/2011 |

(Continued)

*Primary Examiner* — Jong-Suk (James) Lee
*Assistant Examiner* — Colin Cattanach
(74) *Attorney, Agent, or Firm* — Innovation Counsel LLP

(57) ABSTRACT

A frame and a light source module having the same are provided. According to embodiments, there is provided a frame comprising a plurality of bodies spaced apart from one another in one direction and connected to one another by a supporter. The plurality of bodies comprises a light emission window formed at an upper part of a body, a light incidence window formed at a bottom part of the body, and a mounting portion formed between the light emission window and the light incidence window, and including a groove that is formed on an inner wall of the body and is recessed horizontally into the body from the light incidence window.

3 Claims, 27 Drawing Sheets

(56) References Cited

U.S. PATENT DOCUMENTS

2005/0239342 A1* 10/2005 Moriyama ..... F21K 9/00 439/699.2
2008/0111145 A1* 5/2008 Lin ..... H01L 33/507 257/98
2009/0057095 A1* 3/2009 Chien ..... G07D 7/121 194/302
2010/0133556 A1* 6/2010 Li ..... F21K 9/00 257/88
2010/0148193 A1* 6/2010 Duong ..... H01L 33/20 257/88
2010/0149783 A1* 6/2010 Takenaka ..... F21K 9/00 362/84
2010/0232133 A1* 9/2010 Tran ..... B29D 11/00634 362/84
2010/0328961 A1* 12/2010 Kwon ..... F21V 19/001 362/375
2011/0032707 A1* 2/2011 Takashige ..... F21V 5/04 362/277
2011/0085329 A1* 4/2011 Kuo ..... F21V 5/007 362/235
2011/0096526 A1* 4/2011 Katabe ..... H01L 33/507 362/84
2011/0205727 A1 8/2011 Kim et al.
2012/0074849 A1* 3/2012 Kang ..... F21V 19/0015 315/136
2012/0133268 A1* 5/2012 Hwu ..... F21V 31/00 313/489
2013/0026502 A1 1/2013 Park
2013/0050612 A1 2/2013 Hur et al.
2013/0050616 A1 2/2013 Seo et al.
2013/0094179 A1 4/2013 Dai et al.
2013/0105850 A1* 5/2013 Komatsu ..... H01L 33/505 257/98
2013/0181243 A1 7/2013 Wu
2013/0248903 A1 9/2013 Wang et al.
2015/0261076 A1* 9/2015 Dijken ..... H01L 33/507 359/326
2015/0287891 A1* 10/2015 Liu ..... H01L 33/505 257/98
2016/0126704 A1* 5/2016 Horn ..... H01S 5/4025 362/84

FOREIGN PATENT DOCUMENTS

JP 2013-183124 9/2013
KR 10-1134715 8/2011
KR 10-2012-0075015 7/2012
KR 10-2013-0069247 6/2013

* cited by examiner

FRAME AND LIGHT SOURCE MODULE INCLUDING THE SAME

This application claims priority to Korean Patent Application No. 10-2014-0013721 filed on Feb. 6, 2014 in the Korean Intellectual Property Office, the disclosure of which is incorporated herein by reference in its entirety.

BACKGROUND

1. Field

Embodiments relate to a frame and a light source module including the same.

2. Description of the Related Art

Liquid crystal displays (LCDs) have been of great importance in the field of information display technology. LCDs are display devices which include liquid crystal molecules interposed between a pair of glass substrates, and display information by applying power via a power supply on or below the glass substrates so as for the liquid crystal molecules to emit light.

Since LCDs cannot emit light by themselves but modulate light transmittance of light incident thereupon to display an image, an additional device for applying light to a liquid crystal panel, i.e., a backlight unit, is needed.

In the meantime, light-emitting diodes (LEDs), which emit light in response to a current flowing therethrough, have increasingly become popular as a light source for the backlight unit of an LCD. LEDs have been widely used for applications such as lighting devices, electronic display, and backlight units for display devices due to their long lifetime, low power consumption, rapid response speed, and excellent initial driving properties. The LEDs have been enlarging their application areas due to their excellent properties.

When using an LED light source, quantum dot materials may be used to improve the purity of colors. Quantum dot materials emit light when an excited electron relaxes to the ground state and combines with the hole in which the excited electrons make transition from a conduction band to a valence band. The quantum dots have a property to emit light having different wavelengths according to their particle sizes. Since the smaller the quantum dots, the shorter the wavelength of light emitted by the quantum dots, light of a desired wavelength range may be obtained by controlling the size of the quantum dots.

A quantum dot material may be hermetically sealed by a sealing member such as glass, but the sealing member may be highly susceptible to external shocks and may thus be broken easily. In addition, some components such as chromium (Cr) contained in the quantum dot material may cause environmental pollution. Therefore, research has been conducted on ways to prevent a sealing member for sealing a quantum dot material from being easily destroyed.

SUMMARY

Embodiments provide a frame and a light source module which are capable of preventing a quantum dot material from deteriorating due to heat generated by a light-emitting diode (LED) package, and realizing white light with high color reproducibility.

Embodiments also provide a frame and a light source module which are capable of preventing the sealing member of a quantum dot disk having a quantum dot material hermetically sealed therein from being destroyed and easily fixing the quantum dot disk.

Embodiments also provide a frame and a light source module which are capable of preventing light emitted from an LED from leaking through a portion of the light source module where no quantum dot material is provided.

However, embodiments are not restricted to the one set forth herein. The above and other embodiments will become more apparent to one of ordinary skill in the art to which the inventive concept pertains by referencing the detailed description of the embodiments given below.

According to embodiments, there is provided a frame comprising a plurality of bodies spaced apart from one another in one direction and connected to one another by a supporter. Each of the plurality of bodies may comprise a light emission window formed at an upper part of a body, a light incidence window formed at a bottom part of the body, and a mounting portion formed between the light emission window and the light incidence window, and including a groove that is formed on an inner wall of the body and is recessed horizontally into the body from the light incidence window.

The frame may further comprise a plurality of coupling holes formed vertically through the frame and disposed in the supporter.

The light emission window may have a circular horizontal cross-sectional shape.

The light emission window may have a smaller horizontal cross-sectional area than the light incidence windows.

The plurality of bodies may be formed of an opaque material.

The plurality of bodies may be formed of an elastic material.

The elastic material may include a silicon-based resin or rubber.

The mounting portions may further include a first surface parallel to a horizontal plane of the light emission window, a second surface parallel to and spaced apart from the first surface, and a third surface connecting the first surface and the second surface.

The first surface and the second surface may extend in the same direction from the third surface.

The third surface may extend substantially perpendicular to the first surface and the second surface.

According to another embodiments there is provided a light source module comprising a plurality of bodies, and a supporter connecting the plurality of bodies. Each of the plurality of bodies may include a light emission window formed at an upper part of a body, a light incidence window formed at a bottom part of the body, a mounting portion formed between the light emission window and the light incidence window, and including a groove that is formed on the inner wall of the body and is recessed horizontally into the body from the light incidence window, a quantum dot disk mounted in the mounting portion and convert the wavelength of light, and a light source disposed below the body.

The plurality of bodies may be formed of an elastic material.

The quantum dot disk may be further configured to be spaced from the LED chip.

The quantum dot disk may include a quantum dot material, and a sealing material hermetically sealing the quantum dot material and surround the quantum dot material, wherein the light emission window having an inner diameter smaller than that of the quantum dot material included in the quantum dot disk.

The quantum dot disk may be further configured to be crammed into, and thus, mounted into, the mounting portion.

The quantum dot disk may further include a sealing member and a quantum dot material hermitically sealed at the center of the sealing member, and the light emission window has an inner diameter smaller than that of the quantum dot material.

According to another embodiments there is provided a light source module comprising a circuit board, a plurality of light sources arranged on the circuit board and spaced apart from one another, a frame coupled onto the circuit board; and a plurality of quantum dot disks configured to convert the wavelength of light. The frame may include a plurality of bodies spaced apart from one another in a direction in which the light sources are arranged and having a cavity formed in a center portion of each of the plurality of bodies. Each of the plurality of bodies may comprise a light emission window formed at an upper part of a body, a light incidence window formed at a bottom part of the body, and a mounting portion formed between the light emission window and the light incidence window, and including a groove that is formed on inner wall of the body and is recessed horizontally into the body from the light incidence window. The light sources may be disposed below the cavity and each of the plurality of quantum dot disks is inserted into the mounting portion.

The frame may be coupled to the circuit board by a screw.

The plurality of bodies may be connected by a supporter, and the supporter includes coupling holes.

The circuit board and the frame may be coupled by an adhesive layer.

According to embodiments, it is possible to prevent light emitted from an LED from leaking through a portion of the light source module where no quantum dot material is provided.

In addition, it is possible to easily couple a quantum dot disk to a light source module while preventing a sealing member for hermetically sealing a quantum dot material from being destroyed.

Other features and aspects will be apparent from the following detailed description, the drawings, and the claims.

DETAILED DESCRIPTION OF THE EMBODIMENTS

Figure 1:
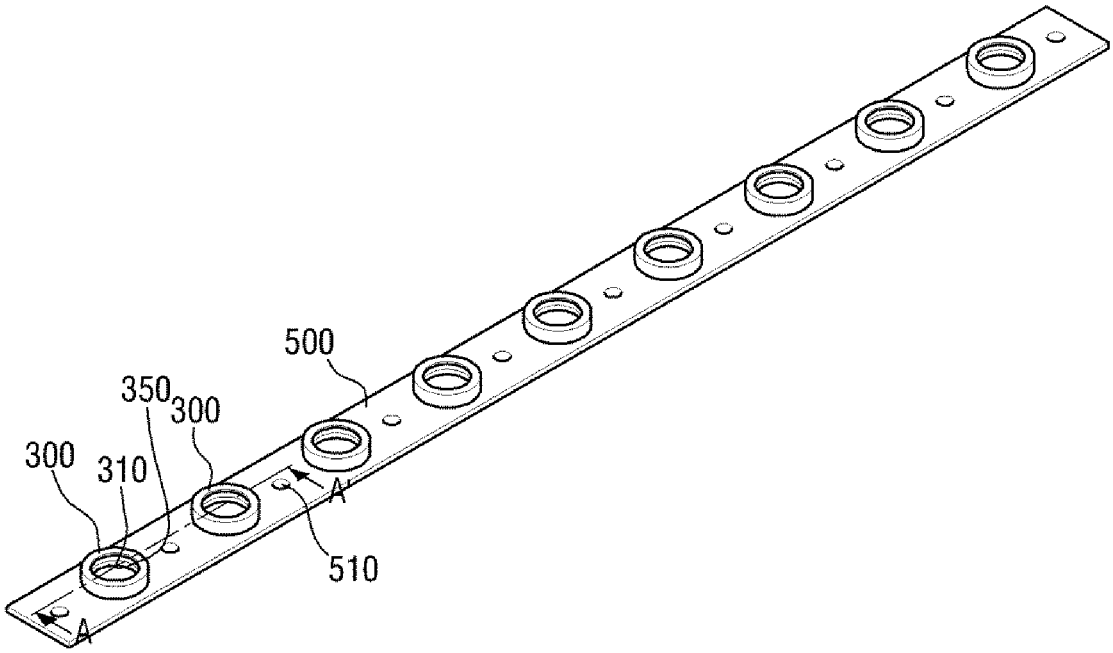
FIG. 1 is a perspective view illustrating a frame according to an embodiment.

The aspects and features of the inventive concept and methods for achieving the aspects and features will be apparent by referring to the embodiments to be described in detail with reference to the accompanying drawings. However, the inventive concept is not limited to the embodiments disclosed hereinafter, but can be implemented in diverse forms. The matters defined in the description, such as the detailed construction and elements, are nothing but specific details provided to assist those of ordinary skill in the art in a comprehensive understanding of the invention, and the inventive concept is only defined within the scope of the appended claims.

The term "on" that is used to designate relative location of an element to another element may include both a case where an element is located directly on another element or a case where an element is located on another element via another layer or another element. In the entire description of the present invention, the same drawing reference numerals are used for the same elements across various figures.

Although the terms "first, second, and so forth" are used to describe diverse constituent elements, such constituent elements are not limited by the terms. The terms are used only to discriminate a constituent element from other constituent elements. Accordingly, in the following description, a first constituent element may be a second constituent element.

Hereinafter, embodiments of the inventive concept will be described with reference to the attached drawings.

Figure 2:
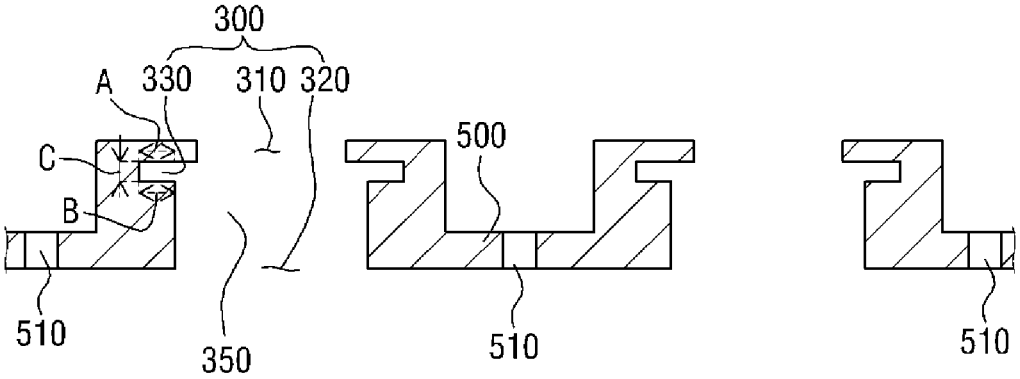
FIG. 2 is a cross-sectional view taken along line A-A' of FIG. 1.

FIG. 1 is a perspective view illustrating a frame according to an embodiment, and FIG. 2 is a cross-sectional view taken along line A-A' of FIG. 1.

Referring to FIGS. 1 and 2, a frame may include a plurality of bodies 300 which are spaced apart from one another in one direction and are connected to one another through a supporter 500 formed therebetween, a plurality of cavities 350 which are formed in the bodies 300 and are open at the top and the bottom thereof, a plurality of light emission windows 310 which are formed at the top of the cavities 350, a light incidence windows 320 which are formed at the bottom of the cavities 350, and a plurality of mounting portions 330, which are grooves formed on the upper inner walls of the bodies 300 and recessed horizontally into the bodies 300.

More specifically, the frame may include the bodies 300, which are arranged in one direction. The bodies 300 may be formed as pillars that protrude upwardly from the supporter 500 and extend in one direction. In an example, the bodies 300 may be formed as cylinders protruding upwardly from the supporter 500, as illustrated in FIG. 1. Empty spaces, i.e., the cavities 350, may be formed in the bodies 300. The cavities 350 may have opening at the top and the bottom thereof and provide spaces to accommodate an LED and a quantum dot disk. The light emission windows 310 may be a top opening of the cavities 350, and the light incidence windows 320 may be a bottom opening of the cavities 350, respectively.

Figure 3:
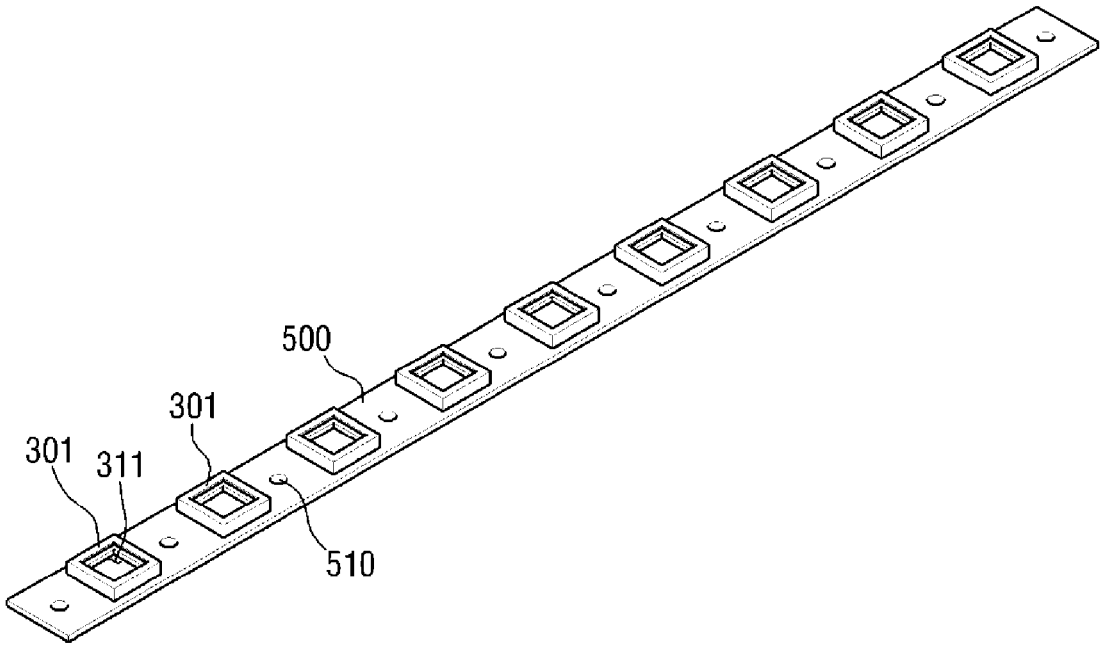
FIG. 3 is a perspective view illustrating a frame according to another embodiment.

Referring to FIG. 3, a frame according to another embodiment may include a plurality of bodies 301 which are formed as rectangular pillars protruding upwardly from a supporter 500 that extends in one direction and a plurality of light emission windows 311 which are formed in the bodies 301. The light emission windows 311 may have a rectangular horizontal cross-sectional shape. Alternatively, the light emission windows 311 may have a circular shape even when the bodies 300 may have a rectangular horizontal cross-sectional shape.

Referring back to FIGS. 1 and 2, the frame may also include a plurality of coupling holes 510 which are disposed among the bodies 300 and are formed vertically through the frame. More specifically, the coupling holes 510 may be formed on the supporter 500 between the bodies 300, i.e. The coupling holes 510 may be provided in such a manner that one coupling hole 510 may be disposed between a pair of adjacent bodies 300 or at every two adjacent bodies 300, or at an interval of more than two bodies 300. The coupling holes 510 may be provided for fixing the frame to a circuit board by using a coupling means such as a screw, and bolt and nuts. The coupling holes 510 may be formed on, but are not limited to, either end of the supporter 500 of the frame. That is, the coupling holes 510 may be formed at various locations on the frame as long as the frame and the circuit board can be properly coupled.

Figure 4:
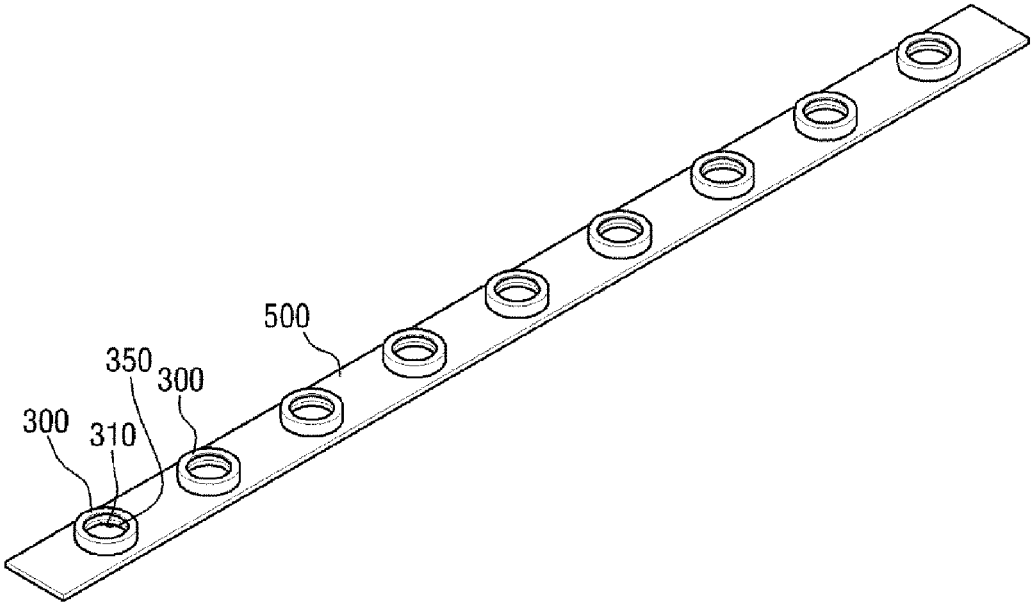
FIG. 4 is a perspective view illustrating a frame according to another embodiment.

Alternatively to the examples illustrated in FIGS. 1 to 3, no coupling holes 510 may be formed on the frame, as illustrated in FIG. 4. In this case, the frame may be coupled to a circuit board by using a resin, an adhesive or a double-sided tape.

Referring to FIG. 4, each of the light emission windows 310 may have a circular horizontal cross-sectional shape. A plurality of quantum dot disks (not illustrated) may be mounted in the mounting portions 330. White light may be emitted from the light emission windows 310 through the quantum dot disks. In response to the light emission windows 310 having a circular horizontal cross-sectional shape, circular white light may be emitted from the light emission window 301, conforming to the horizontal cross-sectional shape of the light emission windows 310.

A plurality of LED chips (not illustrated) may be disposed in the light incidence windows 320. Light emitted from the LED chips may be emitted from the light emission windows 310 to the outside of the bodies 300 via the quantum dot disks mounted in the mounting portions 330. Each of the quantum dot disks includes a quantum dot material provided at the center thereof. The quantum dot materials of the quantum dot disks transform light incident thereupon from the LED chips into white light through wavelength conversion, and emit the white light toward the light emission windows 310. If there are areas in the light emission windows 310 where no quantum dot materials are provided, light emitted from the LED chips may directly transmit through the light emission windows 310 without being subject to wavelength conversion, and as a result, a light leakage phenomenon may occur.

To prevent this, the light emission windows 310 may be configured to have a smaller horizontal cross-sectional area than the light incidence windows 320. In this example, since all parts of the quantum dot disks within the horizontal cross-sectional areas of the light emission windows 310 are covered by quantum dot materials, light emitted from the LED chips may all be transformed into, and emitted as, white light through wavelength conversion.

The bodies 300 may be formed of an opaque material or a reflective material. By forming the bodies 300 of an opaque material or a reflective material, any light not traveling directly toward the light emission windows 310 within the cavities 350 may be reflected within the cavities 350 and may be redirected toward the light emission windows 310, thus enhance the efficiency of light.

The inside of the cavities 350 may be coated with a reflective material so as to allow light emitted from the LED chips to be emitted toward the light emission windows 310 through wavelength conversion performed by the quantum dot disks.

The bodies 300 may be formed of an elastic material such as, for example, a silicon-based resin or rubber. Not only the bodies 300, but also the rest of the frame, may also be formed of a silicon-based resin or rubber.

The quantum dot disks may be mounted on molding frames which are formed of a rigid material and the molding frames are disposed above the LED chips. In this example, an adhesive may be applied onto bottom surfaces of the quantum dot disks or upper surfaces of the molding frame so as to fix the quantum dot disks onto the molding frames. However, the use of an adhesive to mount the quantum dot disks on the frame may complicate the fabrication process of the light source module, and may lower the optical performance of the light source module due to the refraction through the adhesive. In addition, because the sealing members of the quantum dot disks maybe formed of a rigid material such as glass, the quantum dot disks may be easily damaged or destroyed by external shocks during or after the mounting of the quantum dot disks on the molding frames, which are also formed of a rigid material. Moreover, light may be pass through the sealing members of the quantum dot disks, thus unwanted light leakage may be occurred.

On the other hand, when using an elastic material as the bodies 300, the quantum dot disks may be fixed into the mounting portions 330 without the aid of an adhesive, and may be prevented from being destroyed by external shocks. In addition, because the light emission windows 310 are configured to have a smaller horizontal cross-sectional area than the light incidence windows 320, a light leakage phenomenon may be prevented. Moreover, because to the bodies 300 are formed of an elastic material, the quantum dot disks may be inserted into the mounting portions 330 even when the light emission windows 310 are smaller in size than the quantum dot disks by bending the light emission windows 310 or applying force to the light emission windows 310 so as to enlarge the light emission windows 310. Accordingly, the quantum dot disks may be mounted in the frame without the aid of an adhesive.

A method to mount the quantum dot disks in the mounting portions 330 of the frame will be described later in further detail.

Referring back to FIG. 2, each of the mounting portions 330 may include a first surface A which extends in parallel to the horizontal plane of the light emission windows 310, a second surface B which is a predetermined distance apart from the first surface A, and a third surface C which connects the first surface A and the second surface B. The mounting portions 330, into which quantum dot disks are inserted, may include a plurality of grooves, which are formed on the upper inner walls of the bodies 300 where the cavities 350 are recessed horizontally into the bodies 300.

Referring to FIGS. 1 and 2, each of the bodies 300 may be formed as a pillar that protrudes upwardly from the supporter, and may include a groove which is formed on the upper inner wall of a corresponding body 300 and is recessed horizontally into the corresponding body 300. Accordingly, the first surface A may extend into the cavities 350 in parallel to the horizontal plane of the light emission windows 310, the second surface B may extend into the cavities 350 in parallel to the first surface A, and the third surface C may connect the first surface A and the second surface B.

The first surface A and the second surface B may be formed to extend in the same direction from the third surface C. In other words, the first surface A and the second surface B extend in the same direction from the third surface C. The third surface C may extend substantially perpendicular to the first surface A and the second surface B. That is, the first surface A and the second surface B may extend in parallel to each other with respect to the third surface C, and may be connected by the third surface C.

More specifically, the mounting portions 330 may be formed to extend into the bodies 300 from the cavities 350, and to have a vertical cross-sectional shape corresponding to the shape of the quantum dot disks. In an example, the quantum dot disks may have a rectangular vertical cross-sectional shape or may be formed in the shape of plates with rounded corners. In this example, the mounting portions 330 may be formed in the shape illustrated in FIG. 2 to each include the first surface A, the second surface B and the third surface C and thus to be able to hold the outer circumferential portions of the quantum dot disks therein. That is, the mounting portions 330 may have a ⊂-shaped or a ⊃-shaped vertical cross-section.

Figure 5:
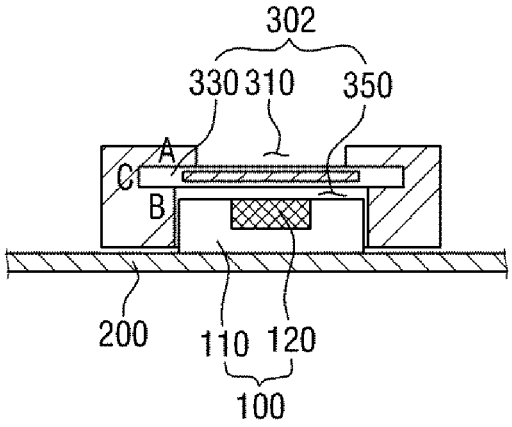
FIG. 5 is a cross-sectional view illustrating a light source module according to an embodiment.
Figure 6:
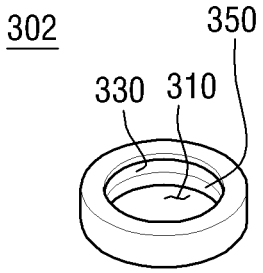
FIG. 6 is a perspective view illustrating a frame according to another embodiment.
Figure 7:
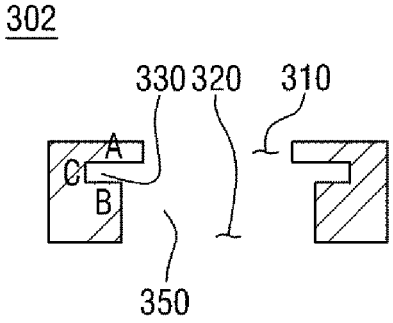
FIG. 7 is a cross-sectional view illustrating the frame of FIG. 6.

A light source module according to an embodiment will hereinafter be described with reference to FIGS. 5 to 7. Referring to FIGS. 5 to 7, a light source module according to an embodiment may include a body 302, a cavity 350 which is formed in the body 302 and is open at the top and the bottom thereof, a light emission window 310 which is formed at the top of the body 302, a light incidence window 320 which is formed at the bottom of the body 302, a mounting portion 330 which includes a groove that is formed on the upper inner wall of the body 302 and is recessed horizontally into the body 302, a quantum dot disk 400 which is mounted in the mounting portion 330 and converts the wavelength of light into white, and a light source 100 which is disposed at a lower portion of the body 302.

FIG. 5 is a cross-sectional view illustrating a light source module according to an embodiment, FIG. 6 is a perspective view illustrating a frame applied to the light source module of FIG. 5, and FIG. 7 is a cross-sectional view illustrating the frame of FIG. 6. As illustrated in FIGS. 6 and 7, a frame applied to the light source module of FIG. 5 may include a single body 302 and a cavity 350 which is formed in the body 302 and is open at the top and the bottom thereof. A light emission window 310 may be formed at the top of the cavity 350, i.e., at the center of the top of the body 302, and a light incidence window 320 may be formed at the bottom of the cavity 350, i.e., at the center of the bottom of the body 302.

The body 302 may also include a mounting portion 330 which includes a groove that is formed on the upper inner wall of the body 302 and is recessed horizontally into the body 302. The mounting portion 330 may include a first surface A and a second surface B which are parallel to each other and a third surface C which extends perpendicular to the first surface A and the second surface B and connects the first surface A and the second surface B. As already mentioned above, the third surface C may have a curved shape, and the first surface A and the second surface B may be formed to extend in the same direction in parallel to each other with respect to the third surface C.

A light source 100 may be disposed at a lower portion of the body 302 where the light incidence surface 320 is formed. The light source 100 may include a molding frame 110 and an LED chip 120 which is disposed in the molding frame 110. The light source 100 may be mounted on, and thus coupled to, a circuit board 200.

The light source 100 may emit light in response to receipt of an electrical signal from the circuit board 200. The circuit board 200 may include a circuit pattern (not illustrated) for applying electrical signals to the LED chip 120 of the light source 200, and the circuit pattern may be formed of a metallic material with excellent electric and thermal conductivities, for example, gold (Au), silver (Ag) or copper (Cu).

The circuit board 200 may be a printed circuit board (PCB), and may be formed of an organic resin material including epoxy, triazine, silicone and polyimide, or another organic resin material. The circuit board 100 may be a flexible PCB (FPCB) or a metal core PCB (MCPCB).

The LED chip 120 may be a blue LED chip or an ultraviolet (UV) LED chip. Light generated by the LED chip 120 may be emitted as white light with high purity by being passed through the quantum dot disk 400.

Referring back to FIG. 5, the quantum dot disk 400, which converts the wavelength of light, may be mounted in the mounting portion 330, which is formed on the upper inner wall of the body 302. The quantum dot disk 400 may include a sealing member 420 such as glass and a quantum dot material 410 which is hermetically sealed in the middle of the sealing member 420. The sealing member 420 may surround the quantum dot material 410. The quantum dot material 410 may be mixed with a polymer material, may fill the inside of the sealing member 420, and may be hermetically sealed in the sealing member 420.

The horizontal cross-sectional area of the light emission window 310 may the light emission window may have an inner diameter smaller than that of the quantum dot material 310 included in the quantum dot disk 400. As a result, when viewed from outside the light emission window 310, only the quantum dot material 410, among other parts of the quantum dot disk 400, may be seen through the light emission window 310. Accordingly, light emitted from the light source 100 may all be transformed into white light by being passed through the quantum dot material 410, and may then be emitted out of the body 302 through the light emission window 310.

The quantum dot material 410 emits light Quantum dot materials emit light when an excited electron relaxes to the ground state and combines with the hole in which the excited electrons make transition from a conduction band to a valence band. Quantum dots that are formed of the same material may have different wavelengths according to their particle sizes. Since the smaller the quantum dots, the shorter the wavelength of light emitted from the quantum dots, light of a desired wavelength range may be obtained by controlling the size of the quantum dots.

The quantum dot material 410 may have a particle size of 10 nm or less. Quantum dots with a size of 55-65 Å emit red light, quantum dots with a size of 40-50 Å emit green light, and quantum dots with a size of 20-35 Å emit blue light. Yellow light may be emitted by quantum dots with a size between the sizes of the red light-emitting quantum dots and the green light-emitting quantum dots.

In a case in which the LED chip 120 is a UV LED chip, three quantum dots that emit red light, blue light and green light, respectively, in response to receipt of UV light may be mixed together to form a white light-emitting quantum dot disk 400. Alternatively, in a case in which the LED chip 120 is a blue LED chip, two quantum dots that emit red light and blue light, respectively, in response to the receipt of blue light may be mixed together to form the white light-emitting quantum dot material 310.

The quantum dot material 410 may include one of Si-based nano crystals, group II-VI compound semiconductor nano crystals, group III-V compound semiconductor nano crystals, group IV-VI compound nano crystals and a mixture thereof.

The group II-VI compound semiconductor nano crystals may include one selected from a group consisting of CdS, CdSe, CdTe, ZnS, ZnSe, ZnTe, HgS, HgSe, HgTe, CdSeS, CdSeTe, CdSTe, ZnSeS, ZnSeTe, ZnSTe, HgSeS, HgSeTe, HgSTe, CdZnS, CdZnSe, CdZnTe, CdHgS, CdHgSe, CdHgTe, HgZnS, HgZnSe, HgZnTe, CdZnSeS, CdZnSeTe, CdZnSTe, CdHgSeS, CdHgSeTe, CdHgSTe, HgZnSeS, HgZnSeTe and HgZnSTe.

The group III-V compound semiconductor nano crystals may include one selected from a group consisting of GaPAs, AlNP, AlNAs, AlPAs, InNP, InNAs, InPAs, GaAlNP, GaAlNAs, GaAlPAs, GaInNP, GaInNAs, GaInPAs, InAlNP, InAlNAs, and InAlPAs.

The IV-VI compound semiconductor nano crystals may be SbTe.

Figure 8:
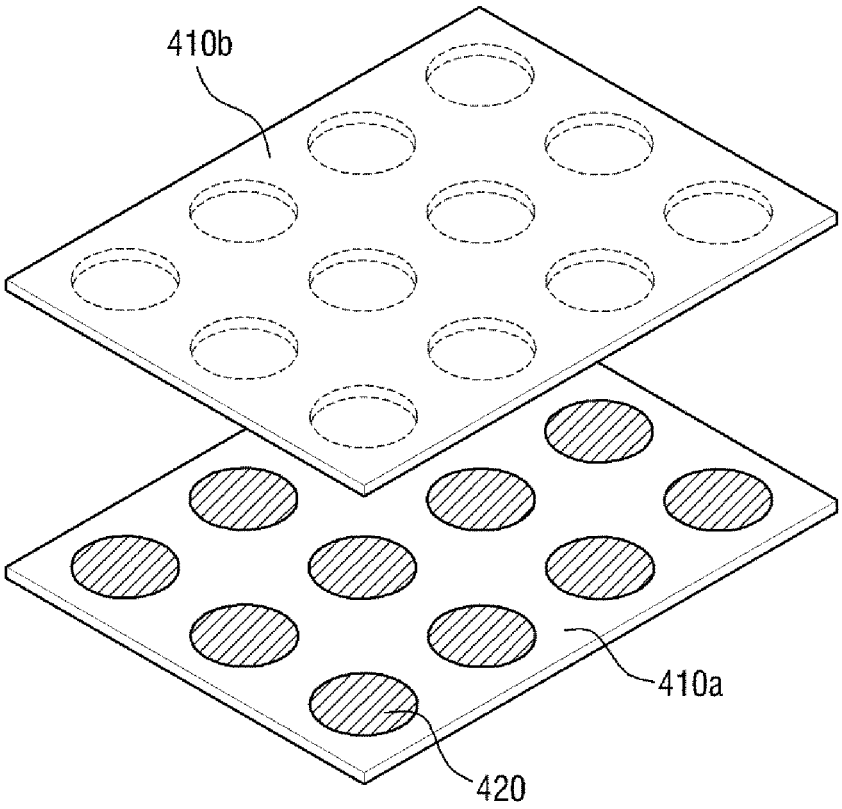
FIGS. 8 to 10 are diagrams illustrating processes for fabricating a quantum dot disk according to an embodiment.
Figure 9:
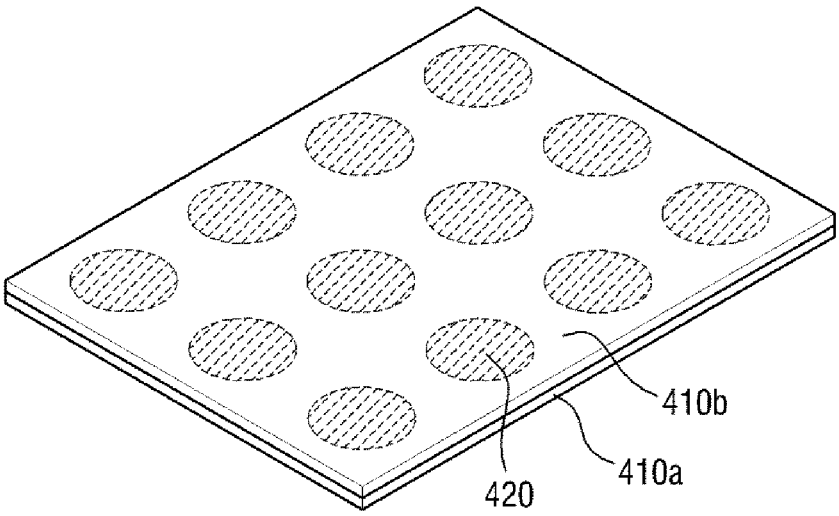
Figure 10:
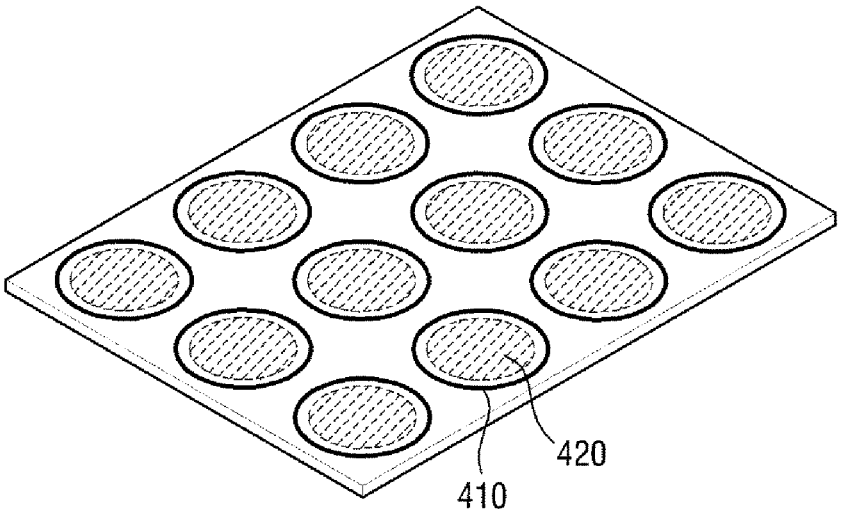

The fabrication of quantum dot disks will hereinafter be described with reference to FIGS. 8 to 10. Referring to FIG. 8, the quantum dot material 410 may be implanted on a lower substrate 420*a*. Referring to FIG. 9, the upper substrate 420*b* and the lower substrate 420*a* may be bonded together by using laser, and as a result, the quantum dot material 410 may be hermetically sealed between the upper substrate 420*b* and the lower substrate 420*a*. Referring to FIG. 10, a cutting operation may be performed by using, for example, laser, and as a result, a plurality of quantum dot disks with a circular horizontal cross-sectional shape may be obtained.

Figure 11:
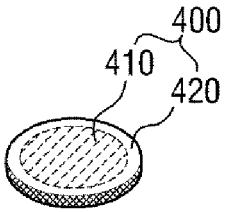
FIG. 11 is a perspective view illustrating a quantum dot disk fabricated by the processes of FIGS. 8 to 10.

FIG. 11 illustrates a quantum dot disk 400 obtained by the processes of FIGS. 8 to 10. Referring to FIG. 11, a quantum disk 400 may include a sealing member 420 and a quantum dot material 410 which is included in the sealing member 420 and has a circular horizontal cross-sectional shape.

Figure 12:
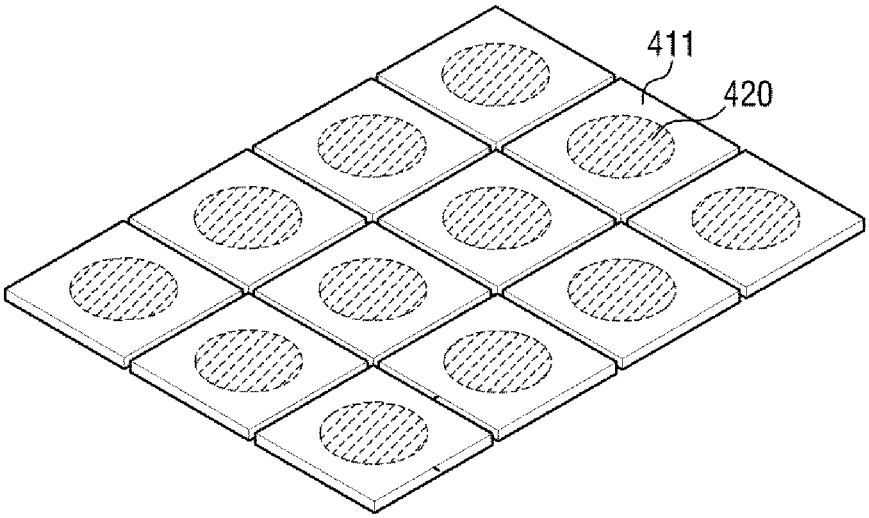
FIG. 12 is a diagram illustrating a process for fabricating a quantum dot disk according to another embodiment.
Figure 13:
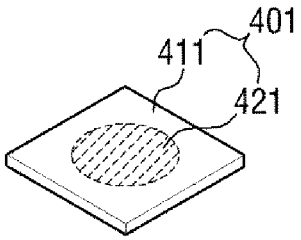
FIG. 13 is a perspective view illustrating a quantum dot disk fabricated by the process of FIG. 12.

The quantum dot disk 400 may be formed to have various horizontal cross-sectional shapes other than a circular horizontal cross-sectional shape. That is, referring to FIG. 13, a quantum dot disk 401 may be formed to have a rectangular horizontal cross-sectional shape. The quantum dot disk 401 may be fabricated by performing a cutting operation as illustrated in FIG. 12.

However, the horizontal cross-sectional shape of the quantum dot disk 400 is not limited to those set forth herein. That is, the quantum dot disk 400 may be formed to have a polygonal cross-sectional shape (such as a pentagonal or hexagonal cross-sectional shape) or to include one or more curved surfaces, and the shape of the quantum dot disk 400 may be modified appropriately, if necessary. In response to the shape of the quantum dot disk 400 being modified, the shape of the body 302 may be modified accordingly.

Also, in response to the shape of the quantum dot disk 400 being modified, the shape of a corresponding light emission window 310 may be modified accordingly, and as a result, the shape of light emitted from the corresponding light emission window 310 may be changed.

Referring back to FIG. 5, the LED chip 120, which is mounted on the circuit board 200, may be disposed in the light incidence window 320. That is, the LED chip 120 may be inserted into the lower portion of the cavity 350, which is formed at the center of the body 302. Accordingly, in response to the LED chip 120 receiving an electrical signal from the circuit board 200 and emitting light, the light pass through the quantum dot material 410 of the quantum dot disk 400 in the cavity 350 may be changed into white light.

Figure 14:
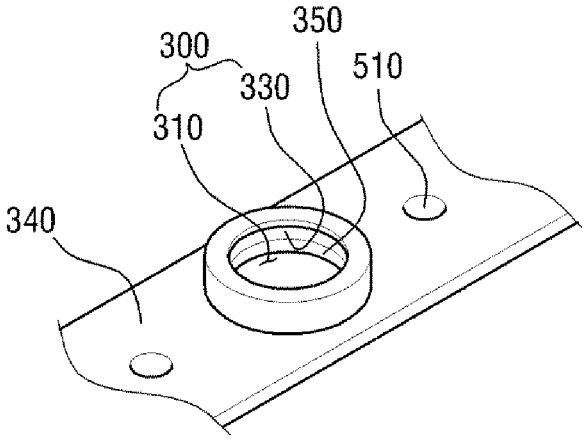
FIG. 14 is a perspective view illustrating a frame according to another embodiment.

The body 302 and the circuit board 200 may be coupled to each other. In an example, the body 302 may be attached onto the circuit board 200 by using the frame of FIG. 6 and an adhesive (not illustrated). Alternatively, as illustrated in FIG. 14, a frame may be formed to include a bent surface 340 extending from a body 300 in parallel to a circuit board 200, and a plurality of coupling hole 510 may be formed on the bent surface 340. In the example of FIG. 14, the body 300 and the circuit board 200 may be coupled to each other by using coupling means such as a screw, and bolt and nuts.

The quantum dot disk 400 may be crammed into the mounting portion 330. The mounting of the quantum dot disk 400 into the mounting portion 330 will be described later in further detail.

The LED chip 120 and the quantum dot disk 400 may be spaced apart from each other. More specifically, the quantum dot material 410, which is included in the quantum dot disk 400, may deteriorate at high temperature, and may thus lower the efficiency of transforming incident light into white light. In a case in which the LED chip 120 and the quantum dot disk 400 are too close to each other, the quantum dot material 410 may easily deteriorate so as to lower the efficiency of wavelength conversion. For this, the mounting portion 330 may be configured to allow the quantum dot disk 400 to be a predetermined distance apart from the LED chip 120.

The quantum dot disk 400 and the LED chip 120 may be disposed in parallel to each other such that light emitted from the surface of the LED chip 120 may travel straight toward the quantum dot disk 400. For this, the mounting portion 330 may extend in parallel to the LED chip 120 such that the quantum dot disk 400, which is mounted in the mounting portion 330, may be parallel to the LED chip 120.

Figure 15:
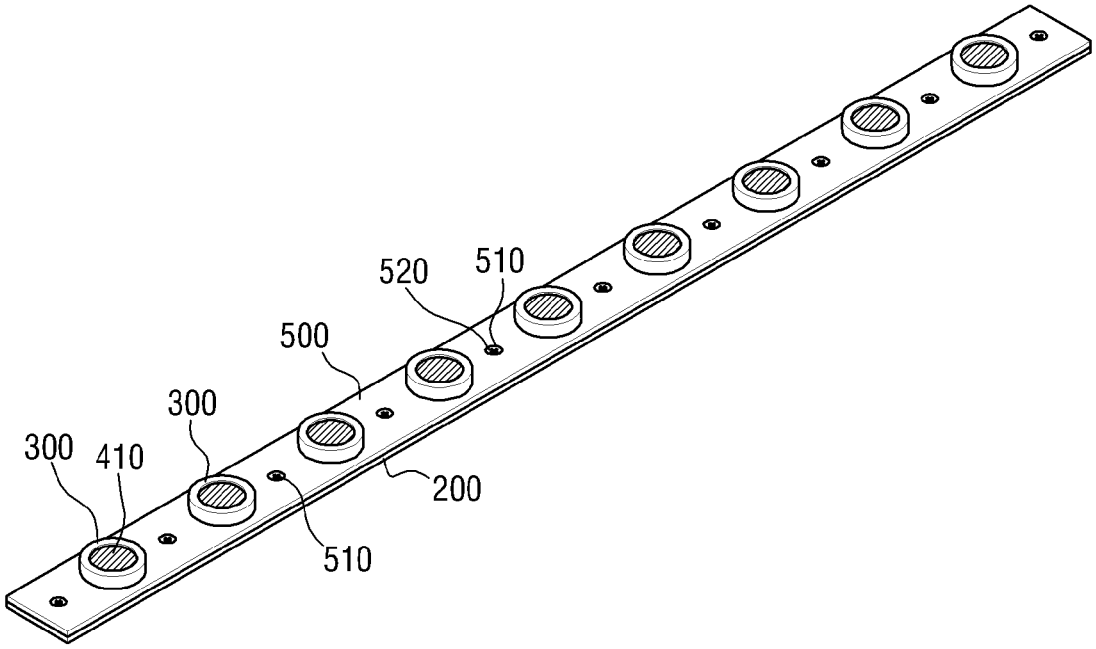
FIG. 15 is a perspective view illustrating a light source module according to another embodiment.
Figure 16:
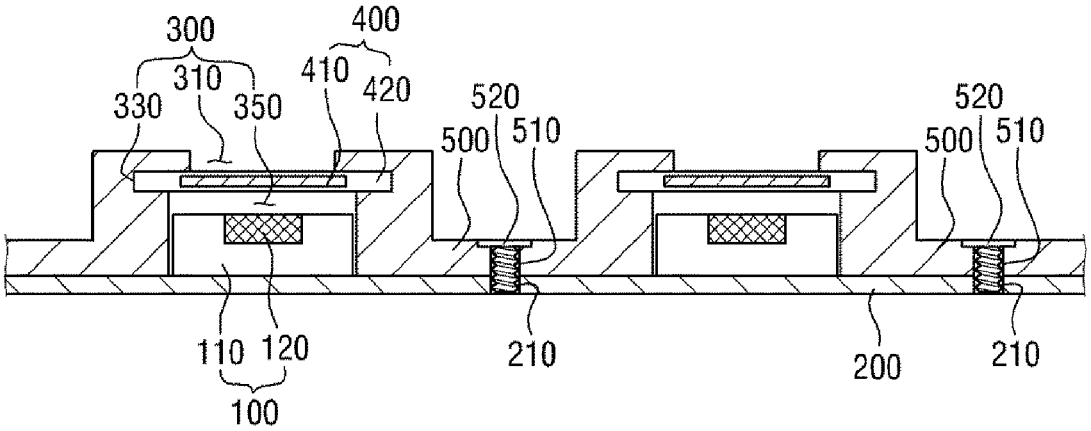
FIG. 16 is a cross-sectional view illustrating the light source module of FIG. 15.

A light source module according to another embodiment will hereinafter be described with reference to FIGS. 15 to 18. FIG. 15 is a perspective view illustrating a light source module according to another embodiment, and FIG. 16 is a cross-sectional view illustrating the light source module of FIG. 15. Referring to FIGS. 15 and 16, a light source module according to another embodiment includes a circuit board 200, a plurality of light sources 100 arranged on the circuit board 200 to be spaced apart from one another in one direction, a frame coupled onto the circuit board 200, and a plurality of quantum dot disks 400 which convert the wavelength of light. The frame includes a plurality of bodies 300 which are spaced from one another in a direction in which the light sources 100 are arranged and are connected to one another through supporter 500, a plurality of cavities 350 which are formed in the bodies 300 and are open at the top and the bottom thereof, and a plurality of mounting portions 330 which are formed on the inner walls of the bodies 300 and are recessed horizontally into the bodies 300. A plurality of LED chips 120 may be disposed below the cavities 350 and the quantum dot disks 400 may be inserted into the mounting portions 330.

Figure 17:
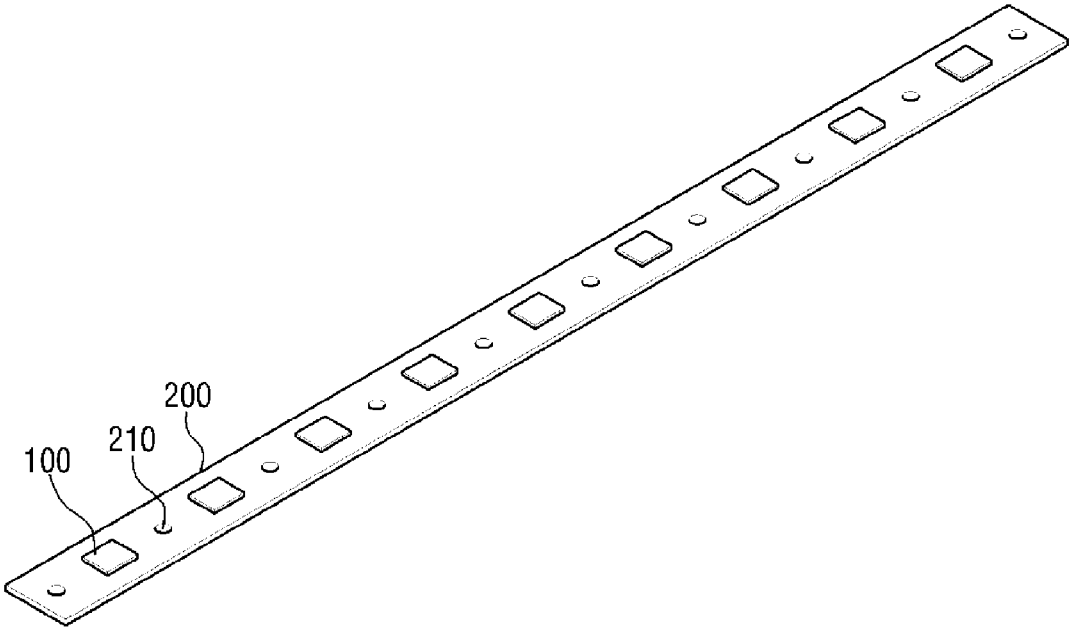
FIG. 17 is a perspective view illustrating a circuit board according to an embodiment.

FIG. 17 illustrates the circuit board 200, which is included in the light source module of FIG. 15 and the light sources 100, which are mounted on the circuit board 200. Referring to FIG. 17, each of the light sources 100 may include an LED chip 120 and a molding frame 110. The light sources 100 may be arranged on the circuit board 200 to be spaced apart from one another. A plurality of holes 210 for coupling the circuit board 200 to a frame (not illustrated) with the use of coupling means such as a screw, and bolt and nuts may be formed on the circuit board 200. In a non-limiting example, the holes 210 may be arranged in such a manner that one hole 210 may be disposed between a pair of adjacent light sources 100 or at every two adjacent light sources 100. In another non-limiting example, the holes 210 may be formed only at either end of the circuit board 200 where the light sources 100 are arranged.

Figure 18:
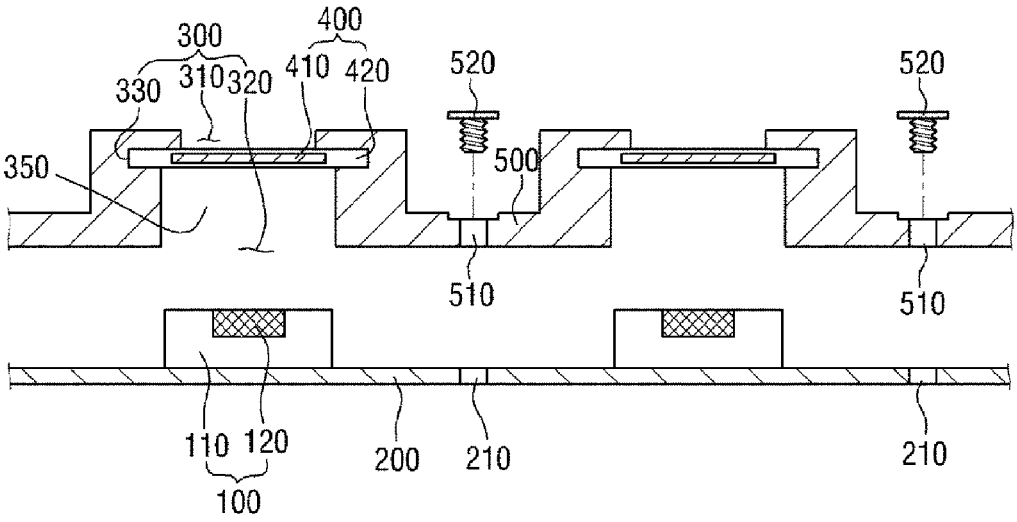
FIG. 18 is a cross-sectional view illustrating a process for fabricating the light source module of FIG. 15.

Referring to FIG. 18, a frame may be coupled onto the circuit board 200 of FIG. 17. More specifically, the frame may be coupled to the circuit board 200 by using a plurality of coupling means such as a screw 520 fixed into a plurality of coupling holes 510 which are formed between a plurality of bodies 300. More specifically, the bodies 300 may be connected to one another by a supporter 500 extends in parallel to the circuit board 200, and the supporter 500 may include the coupling holes 510. Accordingly, the frame and the circuit board 200 may be coupled to each other by screwing the screw 520 into the coupling holes 510.

The frame may include the bodies 300, which are spaced apart from one another in a direction in which a plurality of light sources 100 are arranged. The bodies 300 may include a plurality of cavities 350 which are open at the top and the bottom thereof, and a plurality of mounting portions 330 which are formed on the upper inner walls of the bodies 300 and are horizontally recessed into the bodies 300. The light sources 100 may be disposed below the cavities 350. A plurality of quantum dot disks 400 may be inserted into the respective mounting portions 330.

Figure 19:
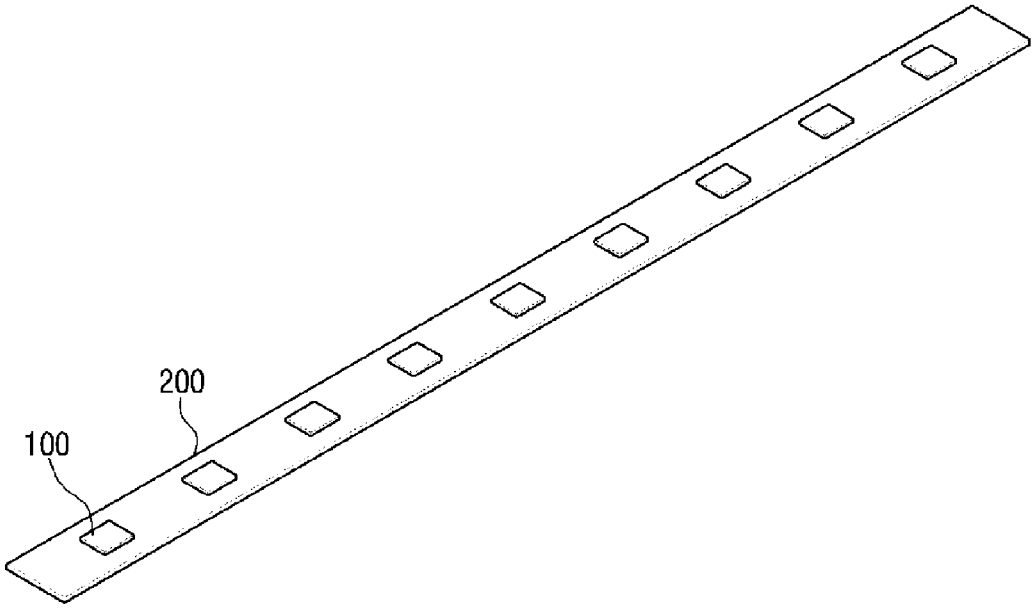
FIG. 19 is a perspective view illustrating a circuit board according to another embodiment.
Figure 20:
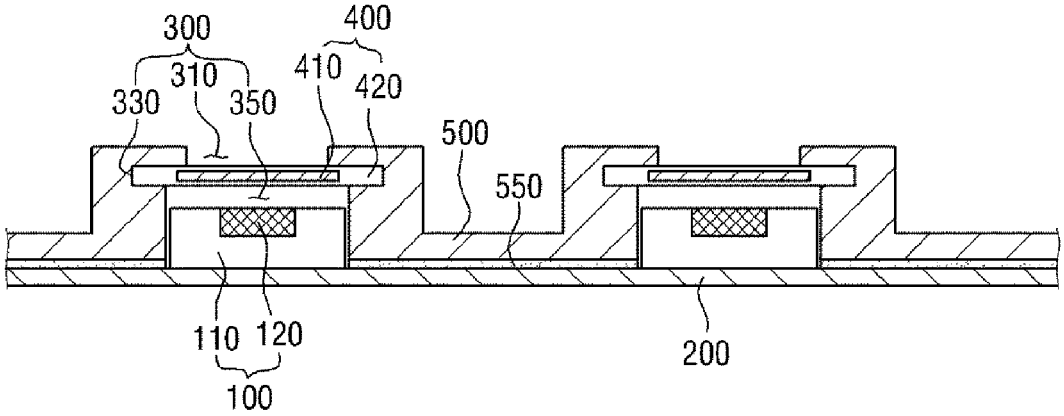
FIG. 20 is a cross-sectional view illustrating a light source module using the circuit board of FIG. 19.

In a non-limiting example, the circuit board 200 may be provided with no holes for bolts to pass through, as illustrated in FIG. 19. In this example, the circuit board 200 and the frame may be coupled together by applying an adhesive or an adhesive tape 550 onto the contact surfaces between the circuit board 200 and the frame, as illustrated in FIG. 20.

The circuit board 200 and the frame may be coupled together in various manners, other than those set forth herein, for example, using hooks.

The coupling relationships between the bodies 300 and the light sources 100 extending along a first direction have already been described with reference to FIGS. 15 and 16, and thus, detailed descriptions thereof will be omitted.

The bodies 300 may be connected to one another by the supporter 500. The supporter 500 may be formed of the same material as the bodies 300, for example, an elastic material such as a silicon-based resin or rubber. Because the supporter 500 is formed of an elastic material, the quantum dot disks 400 may be easily mounted in the mounting portions 330, respectively, without the aid of additional coupling members.

It will hereinafter be described how to insert a quantum dot disk 400 into a mounting portion 330 with reference to FIGS. 21 to 23.

Figure 21:
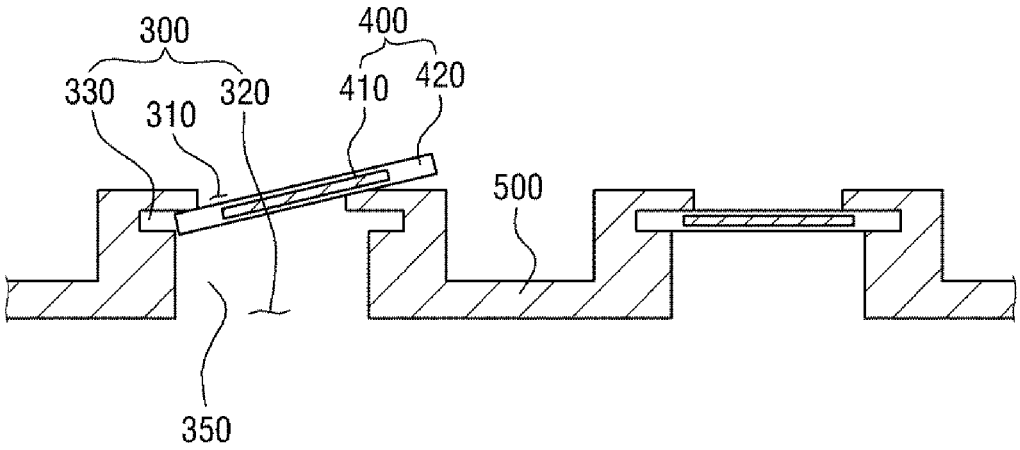
FIGS. 21 to 23 are cross-sectional views illustrating processes for mounting a quantum dot disk on a frame according to an embodiment.

Referring to FIG. 21, a quantum dot disk 400 may be coupled into a mounting portion 330. More specifically, because the bodies 300 are formed of an elastic material such as rubber or a silicon-based resin, the bodies 300 may be easily bent. Accordingly, a first side of a quantum dot disk 400 may be inserted into a mounting portion 330 by bending an upper portion of the body 300 so as for the cavity 350 to be enlarged enough to let the first side of the quantum dot disk 400 into the mounting portion 330. Once the insertion of the first side of the quantum dot disk 400 into the mounting portions 330 is complete, the cavity 350 may return to its original size due to the elasticity of the body 300.

Figure 22:
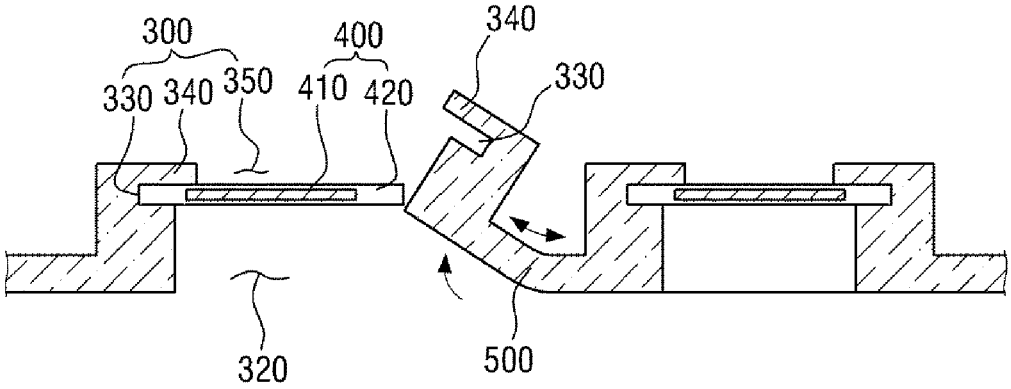
Figure 23:
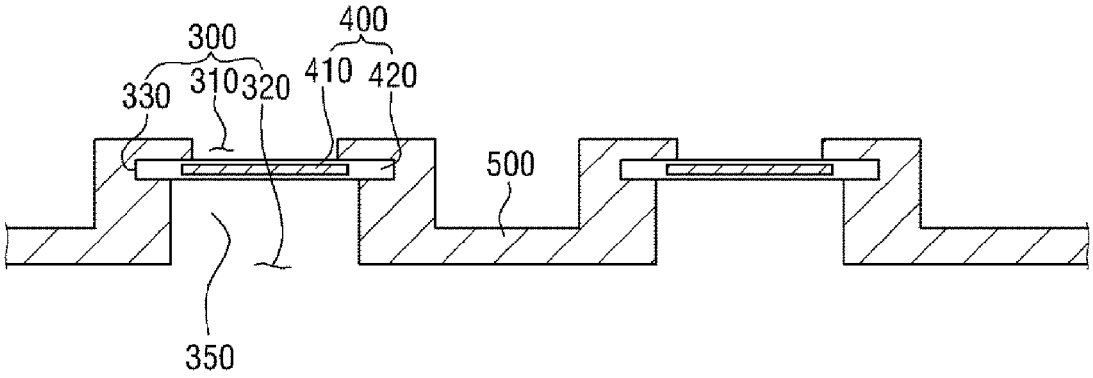

Referring to FIG. 22, a second side of the quantum dot disk 400 may be inserted into the mounting portion 330 by bending the supporter 500 so as for the cavity 350 to be enlarged enough to let the second side of the quantum dot disk 400 in to the mounting portion 330. Once the insertion of the second side of the quantum dot disk 400 into the mounting portions 330 is complete, the supporter 500 may return to its original state, and the quantum dot disk 400 may be completely coupled into the mounting portion 330, as illustrated in FIG. 23.

Figure 24:
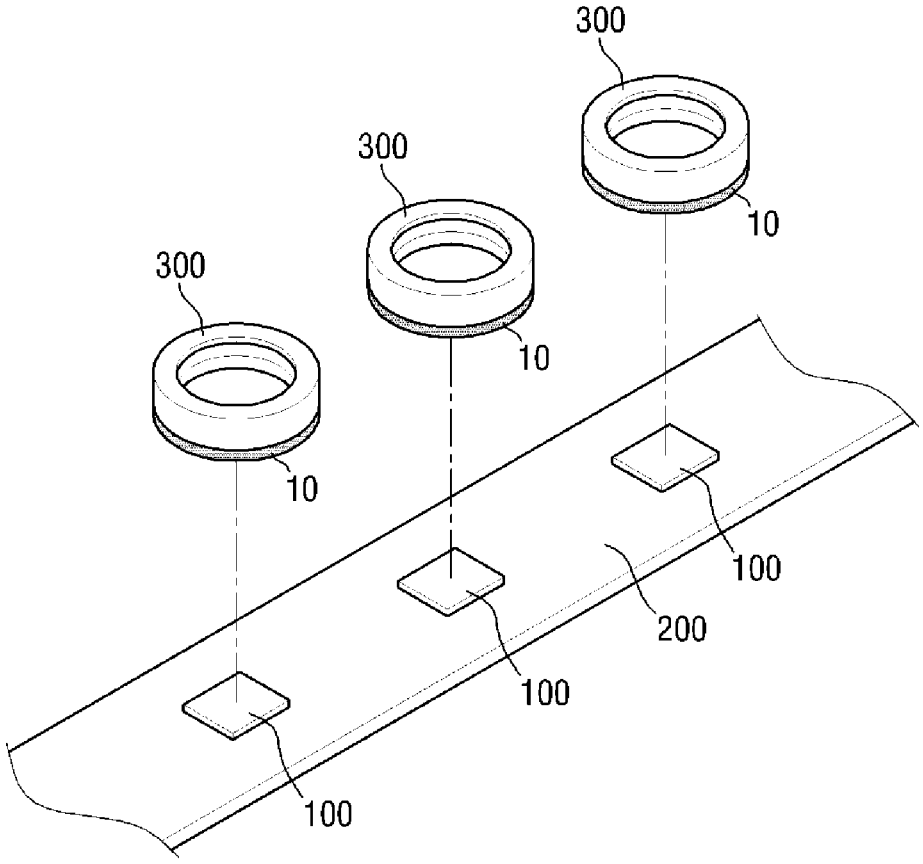
FIGS. 24 and 25 are perspective views illustrating a light source module according to another embodiment.
Figure 25:
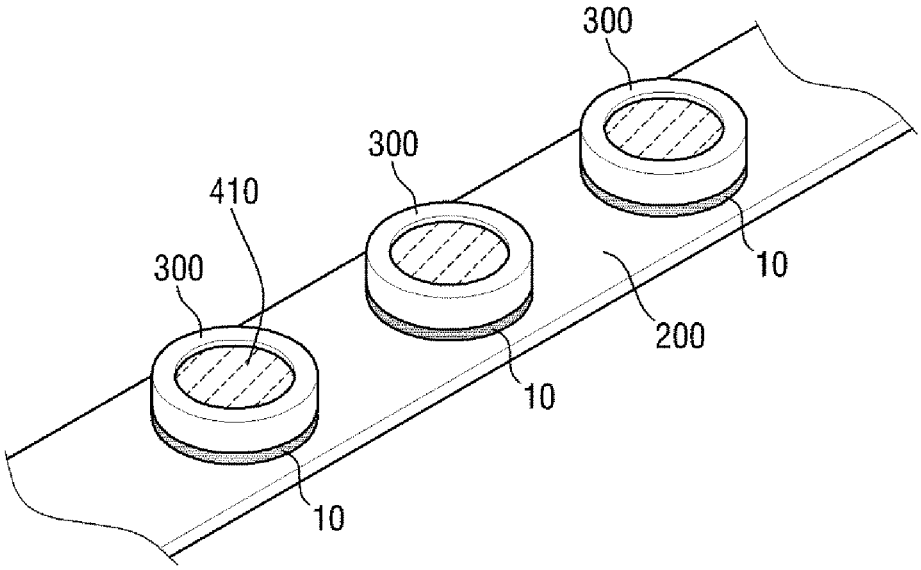
Figure 26:
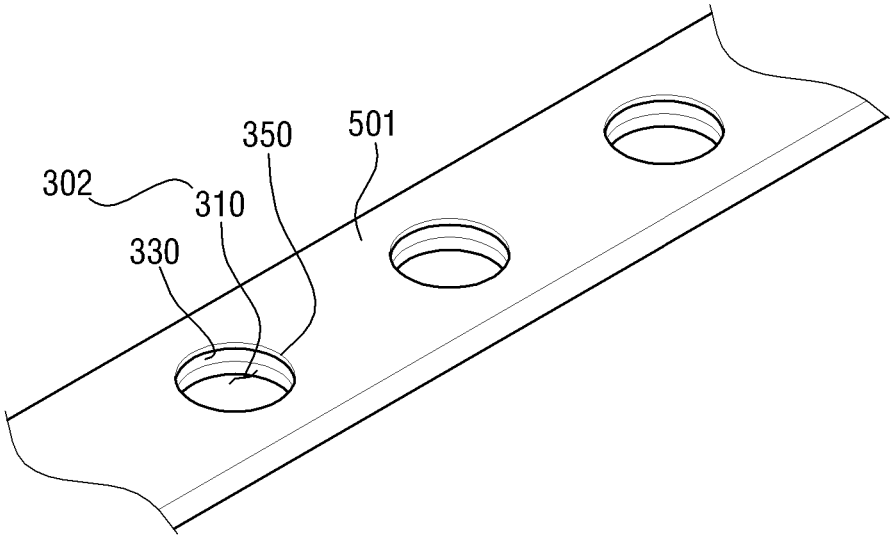
FIG. 26 is a perspective view illustrating a light source module according to another embodiment.
Figure 27:
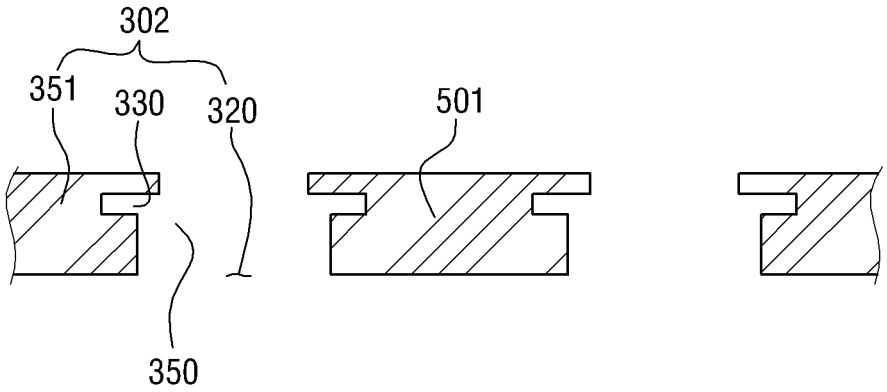
FIG. 27 is a cross-sectional view illustrating the light source module of FIG. 26.

Alternatively, referring to FIGS. 24 and 25, a plurality of bodies 300 may be attached onto the circuit board 200 by using an adhesive 10 so as to correspond to the light sources 100 which are formed on the circuit board 200, are arranged in one direction and are spaced apart from one another. Still alternatively, referring to FIGS. 26 and 27, a frame including a plurality of cavities 350 formed on a supporter 501, instead of a plurality of bodies that protrude from the supporter 501, may be used.

Even though not specifically illustrated, the present inventive concept may provide not only a light source module, but also a backlight unit including the light source module and a liquid crystal display (LCD) including the backlight unit.

The backlight unit may be classified into a direct type or an edge type. In a direct type backlight unit, the light source module may be disposed below a display panel, and optical sheets such as a diffusion plate, a diffusion sheet or a prism sheet may be disposed on the light source module. In an edge type backlight unit, the light source module may be disposed on one side of a light guide plate, and the light guide plate may guide light emitted from the light source module to travel toward a display panel, which is disposed above the light guide plate. A reflective sheet or a reflective pattern may be formed at the bottom of the light guide plate so that light that arrives at the bottom of the light guide plate may be reflected and may thus travel toward the display panel.

The LCD including the backlight unit may include a display panel which is disposed above the backlight unit and displays images.

The LCD may also include a diffusion sheet and a diffusion plate which diffuses light emitted from the light source module or the light guide plate and thus supplies the light to the display panel, and a prism sheet which allows the light diffused by the diffusion sheet or the diffusion plate to be collected in a direction perpendicular to the plane of the display panel. The LCD may use various optical sheets, other than the diffusion sheet, the diffusion plate and the prism sheet, such as a micro lens array sheet and a lenticular lens sheet. The LCD may use two diffusion sheets or two prism sheets, and the arrangement of the optical sheets of the LCD may be adjusted appropriately, if necessary.

The display panel may include a liquid crystal layer interposed between a pair of thin film transistor (TFT) substrates, a color filter substrate, a polarizing filter and a driving integrated circuit (IC). The display panel may display an image to a viewer by adjusting the intensity of light incident thereupon from the backlight unit in response to power being applied thereto by the driving IC. The display panel may be a typical display panel that is well known in the field to which the present inventive concept pertains, and thus, a detailed description thereof will be omitted.

A top chassis including a display window may be deposited on the display panel to cover the display panel.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A light source module, comprising:

a circuit board;

a plurality of light sources arranged on the circuit board and spaced apart from one another;

a frame coupled onto the circuit board; and a plurality of quantum dot disks configured to convert the wavelength of light, wherein the frame includes:

a plurality of bodies spaced apart from one another in a direction in which the light sources are arranged and having a cavity formed in a center portion of each of the plurality of bodies, and a supporter connecting the plurality of bodies, wherein each of the plurality of bodies comprises:

a light emission window formed at an upper part of a body, a light incidence window formed at a bottom part of the body, and a mounting portion formed between the light emission window and the light incidence window, and including a groove that is formed on an inner wall of the body and is recessed horizontally into the body from the light incidence window, wherein the light sources are disposed below a respective cavity of each of the plurality of cavities and each of the plurality of quantum dot disks is inserted into a respective mounting portion of each of the plurality of mounting portions, and wherein the plurality of bodies and the supporter are made of a same material, wherein the plurality of bodies are not in direct contact with each other, wherein the plurality of bodies and the supporter are formed of an elastic material, wherein each of the plurality of quantum dot disks is fixed into the respective mounting portion of each of the plurality of mounting portions without the aid of an adhesive, and wherein the circuit board and the supporter are connected with each other with no space therebetween.

2. The light source module of claim 1, wherein the frame is coupled to the circuit board by a screw.

3. The light source module of claim 2, wherein the supporter includes coupling holes disposed between adjacent bodies.

* * * * *